US008813268B1

(12) United States Patent
Fitzgerald et al.

(10) Patent No.: US 8,813,268 B1
(45) Date of Patent: Aug. 26, 2014

(54) LIGHTED HEADWEAR WITH RECESSED LIGHT SOURCE AND LENS

(75) Inventors: Robert E. Fitzgerald, N. Barrington, IL (US); Caitlin A. Fitzgerald, N. Barrington, IL (US)

(73) Assignee: Outdoor Cap Company, Inc., Bentonville, AR (US)

( * ) Notice: Subject to any disclaimer, the term of this patent is extended or adjusted under 35 U.S.C. 154(b) by 0 days.

(21) Appl. No.: 13/602,801

(22) Filed: Sep. 4, 2012

Related U.S. Application Data

(60) Provisional application No. 61/531,065, filed on Sep. 5, 2011.

(51) Int. Cl.
*A42B 1/24* (2006.01)
*A42B 3/04* (2006.01)
*A42B 1/00* (2006.01)

(52) U.S. Cl.
CPC ..... *A42B 1/242* (2013.01); *A42B 3/044* (2013.01)
USPC ..... 2/422

(58) Field of Classification Search
CPC ..... A42B 1/062; A42B 1/24; A42B 1/244; A42B 1/004; A42B 1/02; A42B 1/04; A42B 1/06; A42B 1/061; A42B 3/227; A42B 3/044; G09F 21/02; A61F 9/045; A41D 13/1184; B29L 2031/4814; F21V 33/0008; F21V 21/084; F21V 14/065; F21V 21/145; F21V 5/04; F21V 21/32; F21V 33/0004; F21V 33/0064; F21V 33/0068; F21Y 2101/02; F21Y 2103/003; F21Y 2113/00
See application file for complete search history.

(56) References Cited

U.S. PATENT DOCUMENTS

| | | | | | |
|---|---|---|---|---|---|
| 1,744,777 | A | * | 1/1930 | Lundgren | 362/106 |
| 2,203,028 | A | * | 6/1940 | Parrillo | 362/106 |
| 3,032,647 | A | * | 5/1962 | Wansky et al. | 362/191 |
| 3,133,705 | A | * | 5/1964 | Eickelman | 362/106 |
| 3,350,552 | A | * | 10/1967 | Lawrence | 362/105 |
| 4,283,127 | A | * | 8/1981 | Rosenwinkel et al. | 351/158 |
| 4,298,913 | A | * | 11/1981 | Lozar | 362/103 |
| 4,406,040 | A | * | 9/1983 | Cannone | 24/3.12 |
| 4,827,384 | A | * | 5/1989 | Von Schlemmer | 362/106 |
| 4,991,068 | A | * | 2/1991 | Mickey | 362/106 |
| 5,230,558 | A | * | 7/1993 | Jong | 362/105 |

(Continued)

OTHER PUBLICATIONS

"Light-emitting diode (LED)." Encyclopaedia Britannica. Encyclopaedia Britannica Online Academic Edition. Encyclopædia Britannica Inc., 2013. Web. Nov. 22, 2013. <http://www.britannica.com/EBchecked/topic/340594/light-emitting-diode>.*

*Primary Examiner* — Bobby Muromoto, Jr.
(74) *Attorney, Agent, or Firm* — Head, Johnson & Kachigian, P.C.

(57) ABSTRACT

Lighted headwear having a brim and a light unit located within the brim. The light unit includes: a holder with a front end and a back end; at least one lens located within the holder at the front end of the holder; and at least one light source located within the holder and axially spaced from the at least one lens such that light produced by the light source projects along the holder, through the lens, and out the front end of the holder. The lighted headwear produces a narrower, longer-distance beam of light than typical lighted headwear, more akin to the light produced by a flashlight or torch, while maintaining the look of a normal hat or cap.

18 Claims, 13 Drawing Sheets

(56) References Cited

U.S. PATENT DOCUMENTS

| | | | | |
|---|---|---|---|---|
| 5,331,357 | A * | 7/1994 | Cooley et al. | 351/158 |
| 5,357,409 | A * | 10/1994 | Glatt | 362/105 |
| 5,404,593 | A * | 4/1995 | Kronenberger | 2/195.1 |
| 5,408,393 | A * | 4/1995 | Becker | 362/105 |
| 5,463,538 | A * | 10/1995 | Womack | 362/106 |
| 5,485,358 | A * | 1/1996 | Chien | 362/106 |
| 5,510,961 | A * | 4/1996 | Peng | 362/106 |
| 5,541,816 | A * | 7/1996 | Miserendino | 362/106 |
| 5,667,292 | A * | 9/1997 | Sabalvaro, Jr. | 362/106 |
| 5,688,039 | A * | 11/1997 | Johnson | 362/106 |
| 5,741,060 | A * | 4/1998 | Johnson | 362/106 |
| 5,836,673 | A * | 11/1998 | Lo | 362/184 |
| 5,911,494 | A * | 6/1999 | Lary | 362/106 |
| 5,946,071 | A * | 8/1999 | Feldman | 351/41 |
| 5,997,165 | A * | 12/1999 | Lehrer | 362/581 |
| 6,056,413 | A * | 5/2000 | Urso | 362/106 |
| 6,168,286 | B1 * | 1/2001 | Duffy | 362/106 |
| 6,206,543 | B1 * | 3/2001 | Henry | 362/191 |
| 6,244,721 | B1 * | 6/2001 | Rodriguez et al. | 362/106 |
| 6,250,769 | B1 * | 6/2001 | Kirk | 362/106 |
| 6,290,368 | B1 * | 9/2001 | Lehrer | 362/187 |
| 6,390,640 | B1 * | 5/2002 | Wong et al. | 362/105 |
| 6,554,444 | B2 * | 4/2003 | Shimada et al. | 362/103 |
| 6,604,837 | B2 * | 8/2003 | Sandberg | 362/191 |
| 6,612,695 | B2 * | 9/2003 | Waters | 351/158 |
| 6,634,031 | B1 * | 10/2003 | Schlapkohl | 2/209.13 |
| 6,659,618 | B2 * | 12/2003 | Waters | 362/106 |
| 6,721,962 | B1 * | 4/2004 | Polaire | 2/209.13 |
| 6,733,150 | B1 * | 5/2004 | Hanley | 362/106 |
| 6,837,590 | B2 * | 1/2005 | Marston | 362/103 |
| 6,863,416 | B2 * | 3/2005 | Waters | 362/105 |
| 6,895,602 | B2 * | 5/2005 | Schlapkohl | 2/209.13 |
| 6,932,487 | B2 * | 8/2005 | Aknine | 362/106 |
| 6,935,761 | B2 * | 8/2005 | Vanderschuit | 362/106 |
| 6,994,445 | B1 * | 2/2006 | Pomes | 362/106 |
| 7,000,841 | B2 * | 2/2006 | Becker | 235/462.42 |
| 7,086,749 | B1 * | 8/2006 | Hanley | 362/105 |
| 7,104,670 | B2 * | 9/2006 | Waters | 362/200 |
| 7,111,956 | B2 * | 9/2006 | Brown | 362/106 |
| 7,118,241 | B2 * | 10/2006 | Sohn | 362/106 |
| 7,163,309 | B2 * | 1/2007 | Sohn | 362/106 |
| 7,182,478 | B2 * | 2/2007 | Marston | 362/106 |
| 7,234,831 | B1 * | 6/2007 | Hanley | 362/106 |
| 7,427,149 | B2 * | 9/2008 | Sohn | 362/374 |
| 7,431,472 | B2 * | 10/2008 | Becker | 362/106 |
| 7,452,106 | B2 * | 11/2008 | Tseng | 362/276 |
| 7,465,078 | B2 * | 12/2008 | Chang | 362/373 |
| 7,506,992 | B2 * | 3/2009 | Carter | 362/105 |
| 7,566,139 | B1 * | 7/2009 | Dority | 362/105 |
| 7,611,255 | B1 * | 11/2009 | Lagassey | 362/103 |
| 7,753,547 | B2 * | 7/2010 | Waters | 362/106 |
| 7,784,960 | B2 * | 8/2010 | Lahtinen | 362/105 |
| 7,896,524 | B2 * | 3/2011 | Yoneda et al. | 362/282 |
| 7,942,543 | B2 * | 5/2011 | Ritter | 362/103 |
| 8,002,437 | B2 * | 8/2011 | Sohn | 362/249.09 |
| 8,388,164 | B2 * | 3/2013 | Waters | 362/106 |
| 8,491,145 | B2 * | 7/2013 | Waters | 362/106 |
| 8,550,651 | B2 * | 10/2013 | Waters | 362/106 |
| 2003/0189826 | A1 * | 10/2003 | Yoon | 362/205 |
| 2003/0231489 | A1 * | 12/2003 | Hsiao | 362/106 |
| 2004/0228119 | A1 * | 11/2004 | Becker | 362/106 |
| 2005/0078473 | A1 * | 4/2005 | Zuloff | 362/106 |
| 2006/0126323 | A1 * | 6/2006 | Pomes | 362/103 |
| 2007/0064311 | A1 * | 3/2007 | Park | 359/630 |
| 2009/0190338 | A1 * | 7/2009 | Huang | 362/184 |
| 2010/0014286 | A1 * | 1/2010 | Yoneda et al. | 362/231 |
| 2010/0214767 | A1 * | 8/2010 | Waters | 362/106 |
| 2010/0220461 | A1 * | 9/2010 | Naijo | 362/97.1 |
| 2010/0301779 | A1 * | 12/2010 | Spartano et al. | 315/320 |
| 2010/0307931 | A1 * | 12/2010 | Waters | 206/8 |
| 2010/0313335 | A1 * | 12/2010 | Waters | 2/209.13 |
| 2011/0122601 | A1 * | 5/2011 | Waters | 362/106 |
| 2012/0014095 | A2 * | 1/2012 | Waters | 362/106 |
| 2012/0187836 | A1 * | 7/2012 | Hashimoto et al. | 315/51 |
| 2013/0192961 | A1 * | 8/2013 | Waters | 200/43.18 |

* cited by examiner 6
7
8
18

LIGHTED HEADWEAR WITH RECESSED LIGHT SOURCE AND LENS

CROSS REFERENCE

This application is based on and claims priority to U.S. Provisional Application Ser. No. 61/531,065 filed Sep. 5, 2011.

BACKGROUND OF THE INVENTION

1. Field of the Invention

The present invention relates generally to lighted headwear, and more particularly, but not by way of limitation, to a lighted cap with at least one recessed light source and at least one lens.

2. Description of the Related Art

Current lighted headwear typically incorporates multiple light emitting diodes (LEDs) into the brim of a hat to illuminate an area in front of a wearer. A primary drawback of such current lighted headwear is that they do not provide sufficient light for many activities. The lights typically provide a pool of diffuse illumination extending five (5) to twenty (20) feet in front of the wearer, as shown in FIG. 13. This is insufficient to illuminate objects at a distance or to function as a flashlight or torch, as is often expected by consumers.

Current lighted hat designs typically use light emitting diodes (LEDs) because they deliver the brightest light relative to the LEDs small size, require less power to operate for longer periods of time, and provide light that can be directed in a particular direction. Incandescent light bulbs, argon bulbs, krypton bulbs, and xenon bulbs require much more battery power to operate for any length of time, which is undesirable as C and D size batteries do not fit in a hat very well and require some sort of cone shaped device to direct the light coming from the bulb, which would be difficult to fit into a brim of a hat without destroying the integrity of the basic hat/cap design.

Based on the foregoing, it is desirable to provide lighted headwear that provides a narrow beam of light that is focused in one area.

It is further desirable to provide lighted headwear that provides illumination to objects at a further distance than is currently offered.

It is further desirable to provide such illumination via LED or similar miniaturized light technology.

SUMMARY OF THE INVENTION

In general, in a first aspect, the present invention relates to lighted headwear having a brim and a light unit located within the brim. The light unit comprises: a holder with a front end and a back end; at least one lens located within the holder at the front end of the holder; and at least one light source located within the holder and axially spaced from the at least one lens such that light produced by the light source projects along the holder, through the lens, and out the front end of the holder. The lighted headwear may further comprise a crown to which the brim is attached, where the brim has an edge proximate to the crown and an edge distal from the crown and where the light unit is located within the brim such that the lens is proximate the edge distal from the crown and the light produced by the light source projects away from the crown.

The lens may be capable of converging light from the light source to produce a beam of light that is narrower than a beam of light produced by the light source without the lens. At least one lens may be a Fresnel lens and/or a rectangular lens.

The brim may comprise a middle layer, a top layer atop the middle layer, and a bottom layer below the middle layer. The light unit may be located between the top layer and the bottom layer. Alternately, the light unit may extend downward from the brim at an oblique angle such that light produced by the light source is directed through the lens and downward from the brim at the oblique angle.

The holder may be cylindrical, may be shaped like a rectangular parallelepiped, or may have an interior surface and an exterior surface where the interior surface is cylindrical and where the exterior surface is shaped like a rectangular parallelepiped. The holder and the lens may be separate elements, or they may be a single integral unit formed contemporaneously.

The holder may comprise a plurality of chambers, where adjacent chambers are separated by walls and where each chamber houses one of the at least one light source. The chambers may be parallel to each other and the light sources may direct light along parallel paths. A first chamber housing a first light source may be adjacent a second chamber housing a second light source and the first light source may be offset from the second light source such that no part of the first light source laterally overlaps any part of the second light source. The multi-chamber holder may have a single lens, or each chamber may house one of the at least one lens.

The holder may be conical and may have a reflective inner surface such that light from the light source reflects off the reflective inner surface and projects through the lens and out the front end of the holder. The light source may be a wide angle LED and the light unit may further comprise a heat sink.

The lighted headwear may further comprise a second light unit located within the brim and spaced laterally from the light unit. The second light unit may comprise: a second holder with a front end and a back end; at least one lens located within the second holder at the front end of the second holder; and at least one light source located within the second holder and axially spaced from the at least one lens such that light produced by the light source projects along the second holder, through the lens, and out the front end of the second holder.

In another embodiment, the lighted headwear may comprise: a brim comprising a middle layer, a top layer atop the middle layer, and a bottom layer below the middle layer; a void in the middle layer located at an edge of the brim distal from a wearer's head; at least one lens located within the void proximate the edge; and at least one light source located within the void and axially spaced from the at least one lens such that light produced by the light source projects along the void, through the lens, and out the edge of the brim.

DETAILED DESCRIPTION OF THE INVENTION

Figure 1:
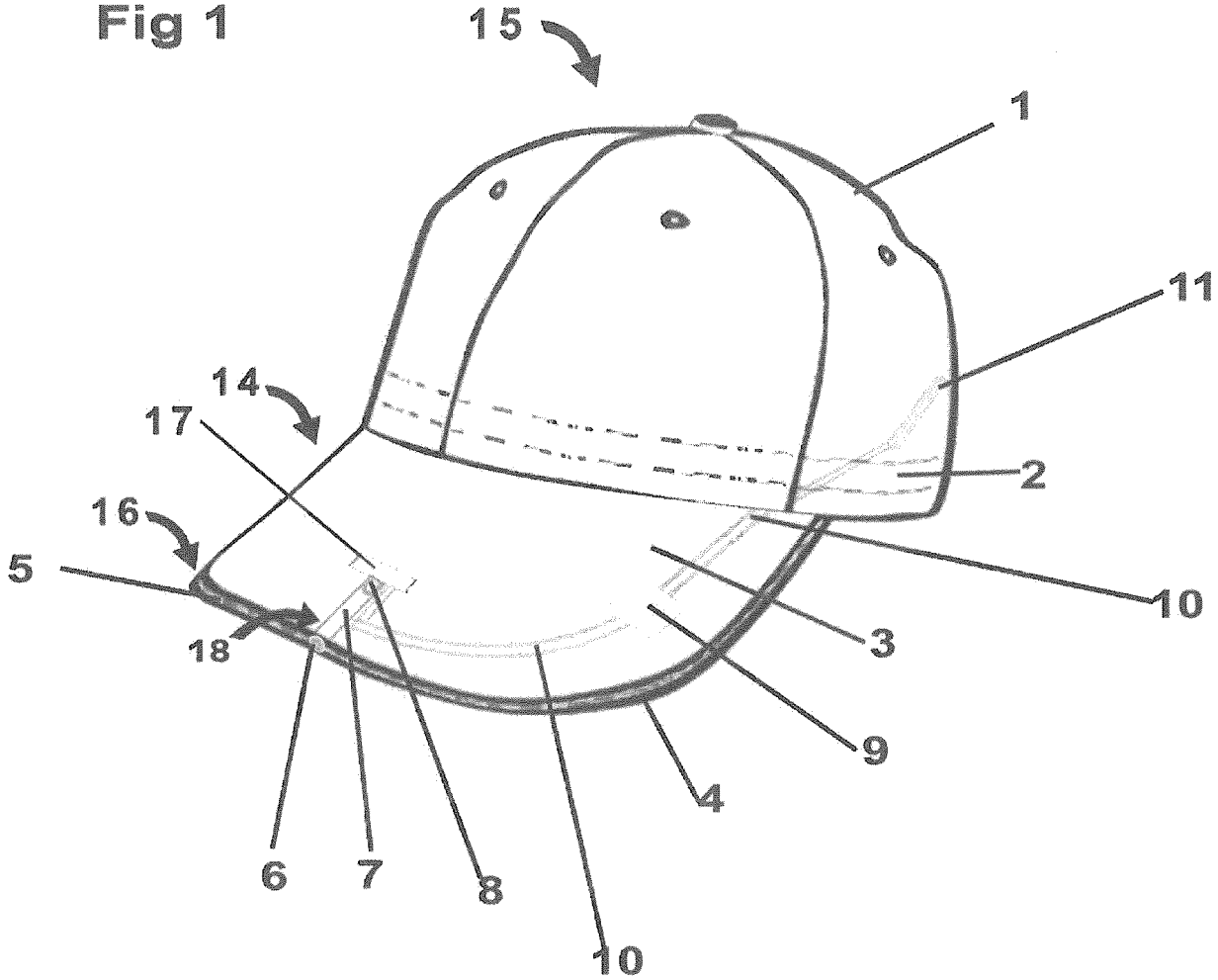
FIG. 1 is a perspective view of lighted headwear with a single recessed light source and lens constructed in accordance with the present invention.

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

Understanding how LEDs work and how a lens works has enabled the lens technology of the present invention to maximize the performance of an LED in lighted headwear. LEDs come in a variety of shapes and sizes; in addition, they also have various brightness amounts measured in millicandela (mcd) and various beam angles that determine the amount of light that is focused in any one direction. The problem with this is that even if you have an LED with a 12 degree angled light in one direction, the amount of light that comes from that 12 degree angle is only 50% of the total LED light output. The other 50% is a wide spray/glow (180 degree spray) that is always present in LEDs. Thus, even if you have an LED with a 60 degree angle directed light, 30 degree angle directed light, or even as narrow as a 12 to 15 degree angle directed light, there is a portion of light that is not being utilized (more or less depending on the percent of degree angle you are using). For example, a 20,000 mcd LED with a 120 degree directed light LED will have approximately 20% of the light wasted that illuminates beyond the 120 degree angle direction of the light. This 120 degree angle directed light will illuminate a two foot area. If you were to use a 20,000 mcd LED with a 15 degree directed angle light, you will have 50% of the LED light output wasted that illuminates beyond the 15 degree directed light. The same 20,000 mcd LED with a 15 degree directed light would appear to provide more light because it has a narrower direction and will illuminate a narrower area. It will also provide light at a greater distance for approximately ten feet.

Taking what is known about LEDs and flashlights, the addition of a separate lens, such as a simple optical lens or something more complex such as a Fresnel type lens, makes it possible to capture all the light and focus this into a beam or any other desired lighting effect. A simple lens is basically an optical device which transmits and refracts light, converging or diverging the light into a focused narrow beam with no spray of light outside the desired area. A more complex lens design can be achieved with other lenses, such as a Fresnel, which will magnify the intensity of the light even more, or a rectangular lens that will deliver a rectangular shaped beam of light.

In general, in a first aspect, the present invention relates to lighted headwear comprising a hat 15 and a light unit 18, where the light unit 18 may comprise at least one light source 8, at least one lens 6, and a holder 7. The holder 7 may hold the lens 6 in place and maintain a precise distance between the light source 8 and the lens 6. The hat 15 may provide illumination for the user of the hat while substantially maintaining the appearance of a traditional hat, cap, or visor.

As seen in FIG. 1, the light unit 18 may be located within a brim 14 of the hat 15, where the brim 14 may be attached to a crown 1 of the hat 15 and the hat 15 may further include a sweatband 2. The crown 1 may be contoured for covering a part of the user's head when worn, and the sweatband 2 may allow more comfort for the user. The brim 14 may be disposed exteriorly of and attached to the crown 1 at a lower edge such that the brim 14 extends outwardly from the crown 1. The hat 15 may be typically worn such that the brim 14 is most proximal to the forehead of the user and extends distally from the forehead of the user. The brim 14 may comprise a top layer of brim material 3, a bottom layer of brim material 4, and a middle layer of brim 5 between the top layer 3 and bottom layer 4. The middle layer 5 may be flexible but stiffer than the top layer 3 and bottom layer 4. The top layer 3 and bottom layer 4 may be attached to the middle layer 5 via stitching, adhesive, or other appropriate attachment mechanisms. The brim 14 may further comprise sandwich/rim/edge material 16 along the edge of the brim 14 most distal from the crown 1.

Figure 3:
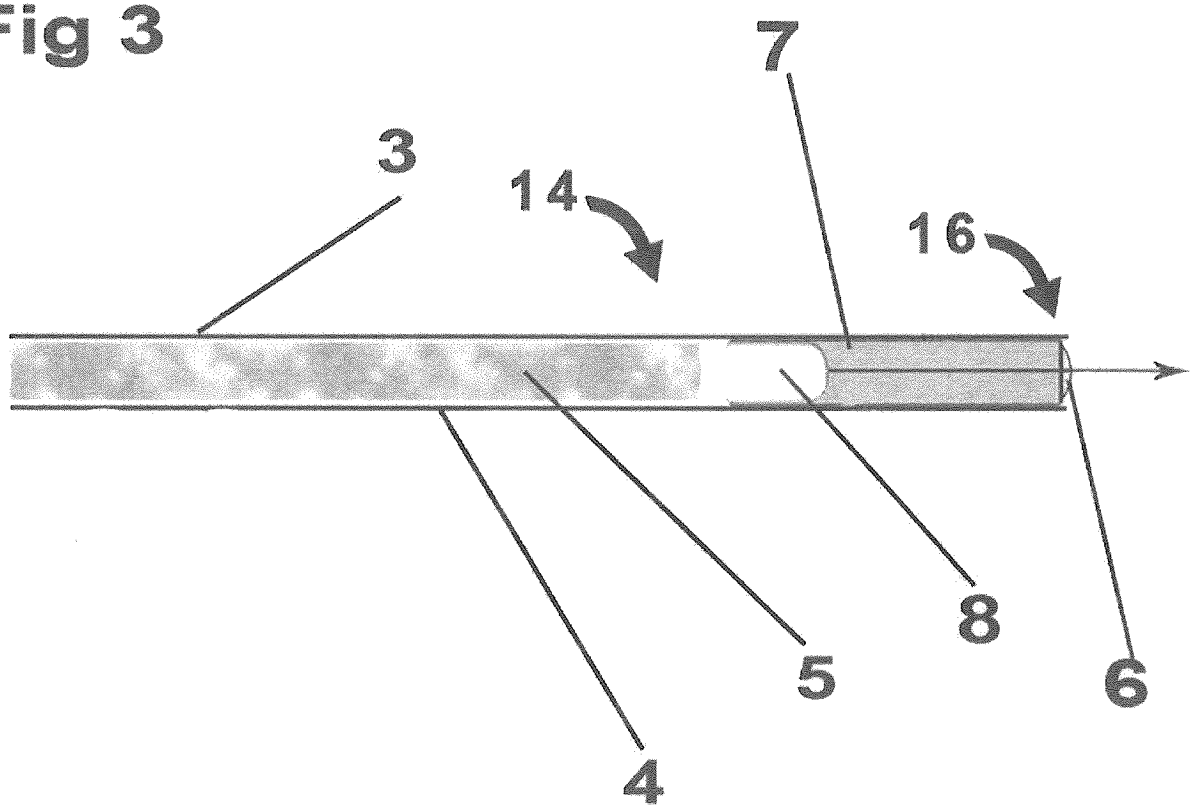
FIG. 3 is a side cross section view of a hat brim with a holder housing a light source and lens therein.
Figure 7:
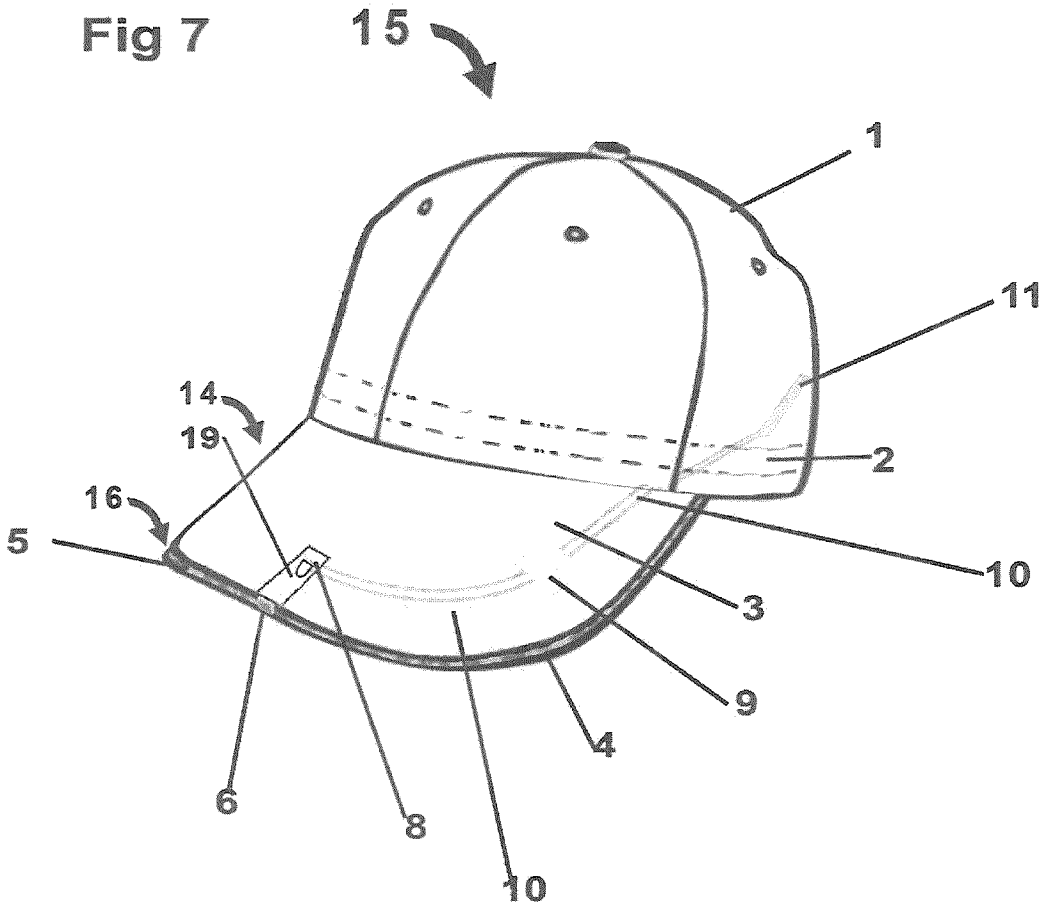
FIG. 7 is a perspective view of lighted headwear with a single recessed light source and lens but no holder.

The light unit 18 may be secured within the brim 14 between the top layer 3 and bottom layer 4. The light unit 18 may be located within a void 19 in the middle layer 5. Alternately, the at least one light source 8 and at least one lens 6 may be located within the void 19, without a holder 7, as seen in FIG. 7. The light unit 18 may be located within the brim 14 such that the lens 6 is proximate to the front of the brim 14 and proximate to the sandwich/rim/edge material 16, distal from the crown 1, as seen in FIG. 3.

FIG. 1 also shows a switch 9, which may be located within the brim 14 and may control the at least one light source 8. The switch 9 may be connected to the light source 8 via wires 10, which may also connect the light source 8 to a power source 11, such as a battery pack. The light source 8 may be connected to the wires 10 via a circuit board 17. The light unit 18, switch 9, and power source 11 may be covertly incorporated into the hat 15 so as to preserve the shape and comfort of a traditional hat, cap, or visor that does not contain a light source. In this manner, an individual may wear the lighted hat 15 that maintains the characteristics and appearance of an unlighted hat.

Figures 2A, 2B, 2C, 2D, 2E, 2F, 2G, 2H, 2I:
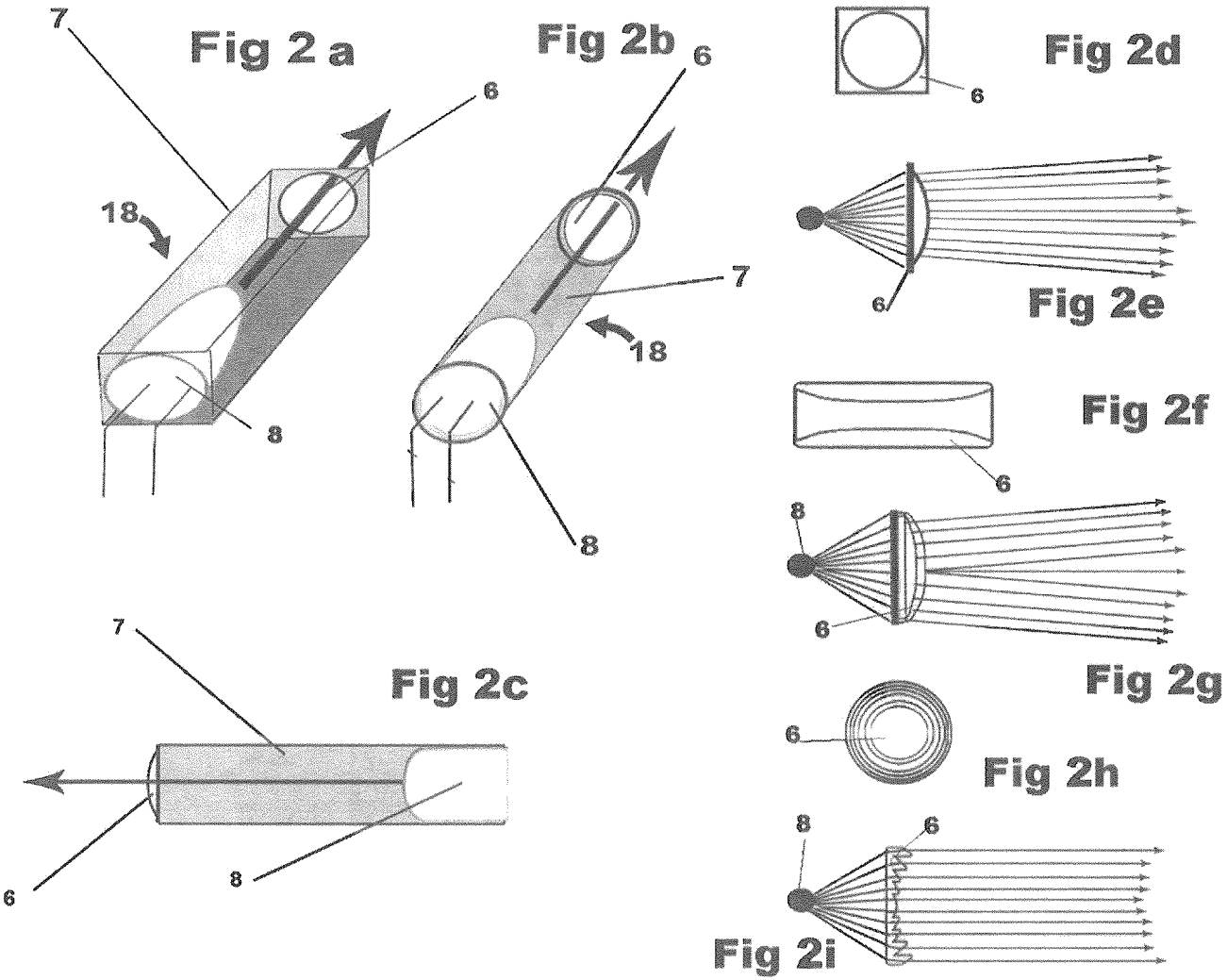
FIG. 2*a* is a perspective view of the light source and lens in a rectangular parallelepiped-shaped holder apart from the head wear.
FIG. 2*b* is a perspective view of the light source and lens in a cylindrical holder.
FIG. 2*c* is a side view of the light source and lens in a holder.
FIG. 2*d* is a front view of a simple lens in a rectangular parallelepiped-shaped holder.
FIG. 2*e* is a side view of the light path produced by a single recessed light source and a simple lens.
FIG. 2*f* is a front view of a rectangular lens in a rectangular parallelepiped-shaped holder.
FIG. 2*g* is a side view of the light path produced by a single recessed light source and a rectangular lens.
FIG. 2*h* is a front view of a Fresnel lens in a cylindrical holder.
FIG. 2*i* is a side view of the light path produced by a single recessed light source and a Fresnel lens.

The at least one light source 8 may be one or more LEDs or other miniature light sources. The holder 7 may be cylindrical, as seen in FIG. 2*b*, or shaped like a rectangular parallelepiped, as seen in FIG. 2*a*, or any other appropriate shape that holds the light source 8 and the lens 6 in place within the brim 14. For example, the holder 7 may have a rectangular outside and a cylindrical inside. The holder 7 may be made of any appropriate material, such as Acrylonitrile butadiene styrene (ABS), a polycarbonate plastic, or synthetic or semi-synthetic organic solids that are moldable. The holder 7 may alternately be made of metal or glass. The lens 6 may be made of polycarbonate or glass type material. The holder 7 and the lens 6 may be a single unit, or may be separate. If separate, the lens 6 may be attached to the holder 7 via adhesive. If a single unit, the lens 6 and holder 7 may be molded at the same time, making the lens 6 and holder 7 one unit instead of two pieces.

The light source 8 may project light forward through the holder 7 and through the lens 6, as indicated by the arrow in FIG. 2*c*. The lens 6 may be a regular lens, as seen in FIG. 2*d*, which may produce a light path as indicated by arrows in FIG. 2*e*; a rectangular lens, as seen in FIG. 2*f*, which may produce a light path as indicated by arrows in FIG. 2*g*; a Fresnel lens, as seen in FIG. 2*h*, which may produce a light path as indicated by arrows in FIG. 2*i*; or any other appropriate lens. The Fresnel lens divides the lens into a set of concentric annular sections.

Figure 4:
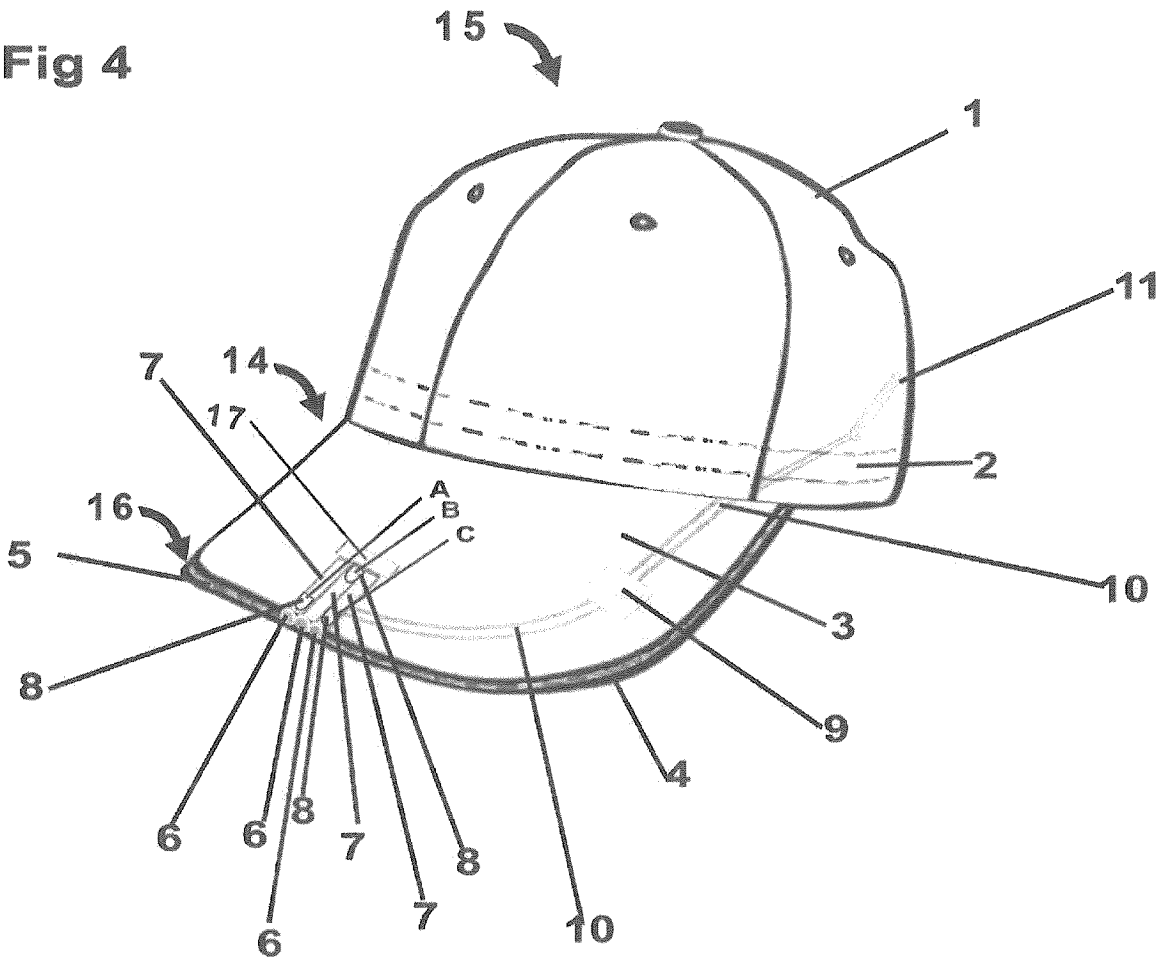
FIG. 4 is a perspective view of lighted headwear with three recessed light sources and three lenses.
Figure 5:
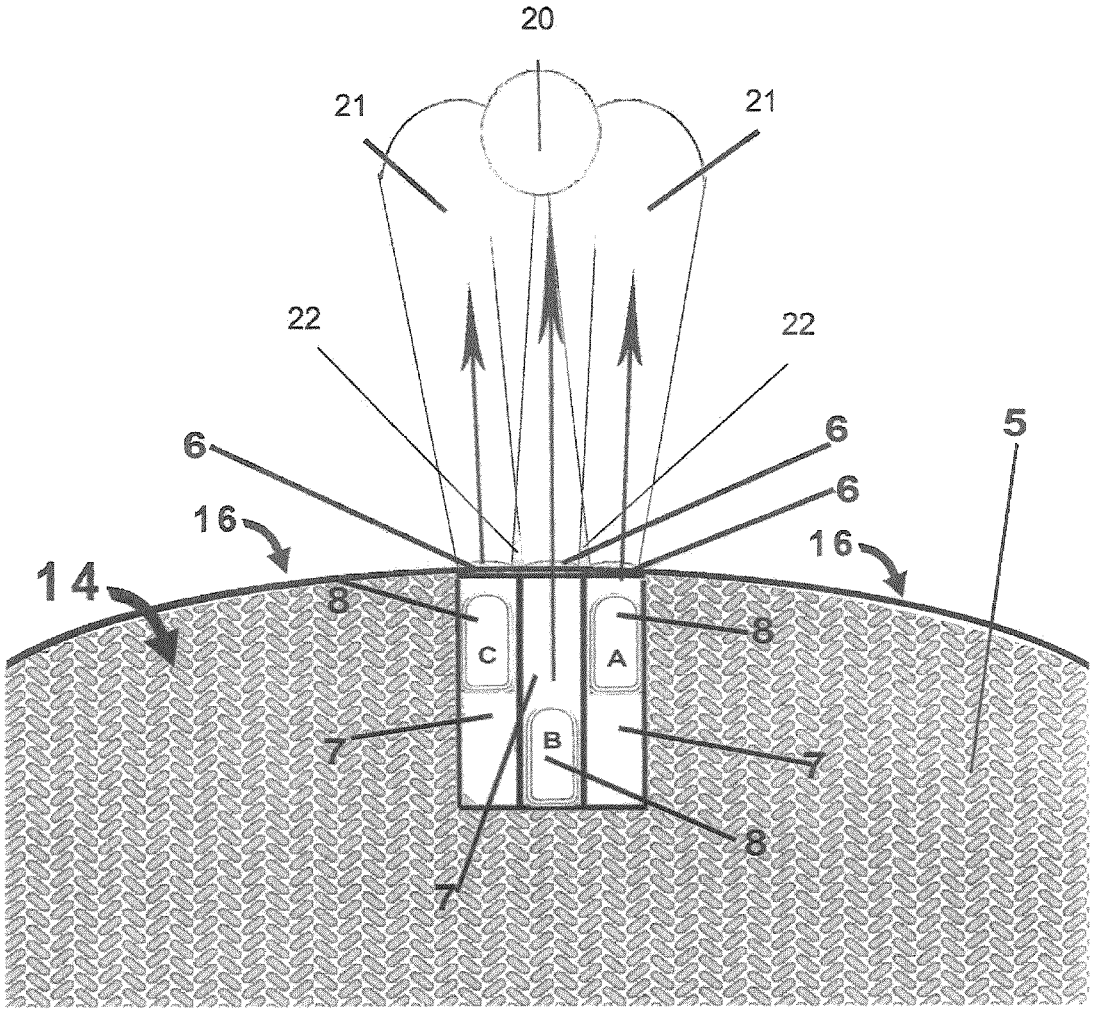
FIG. 5 is a top cross section view of a hat brim with a three-light, three-lens holder showing resulting lighted areas.
Figure 6:
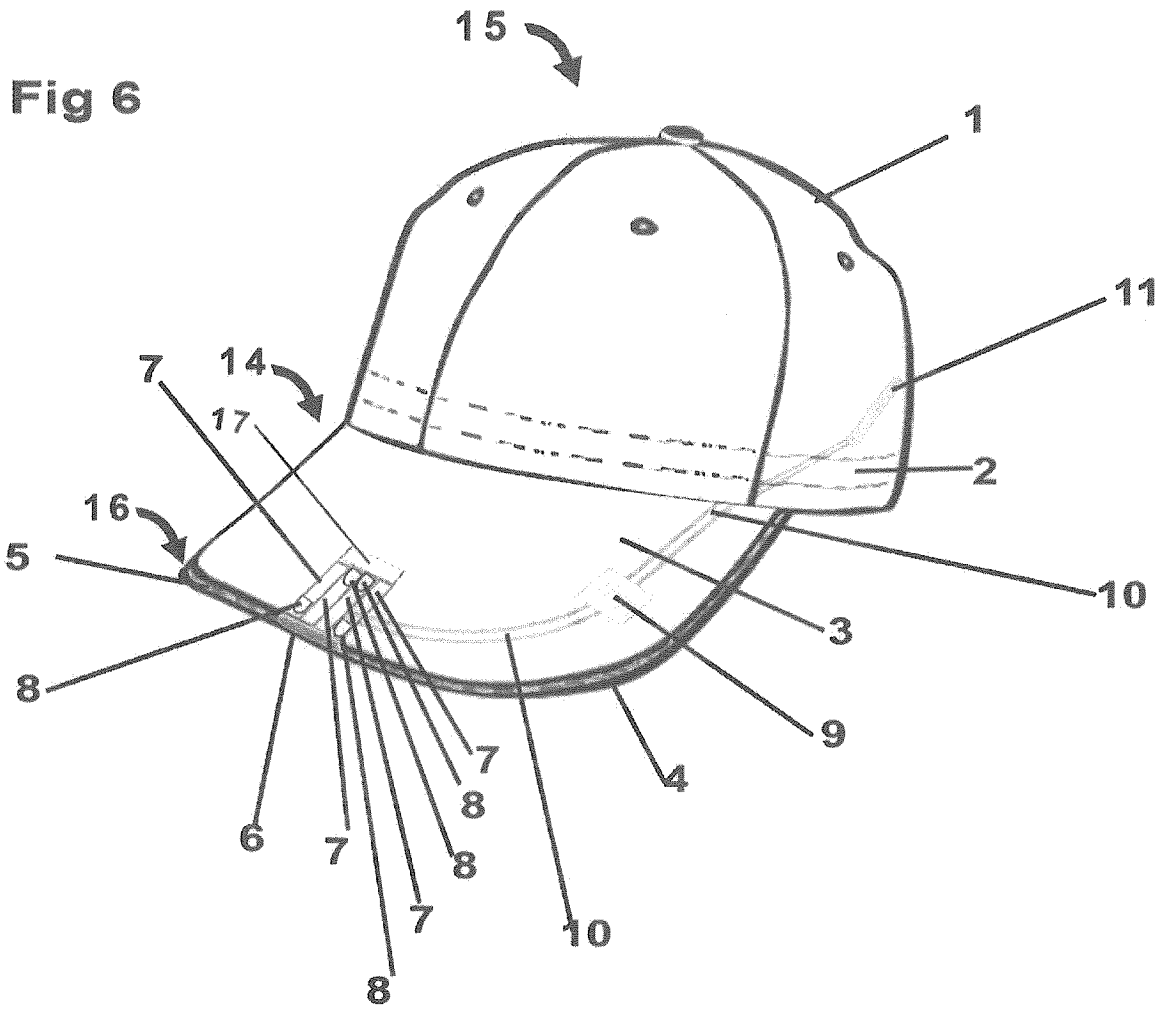
FIG. 6 is a perspective view of lighted headwear with four recessed light sources and a single lens.

The unit 18 may comprise a single light source 8 and a single lens 6 within a single chamber holder 7, as seen in FIG. 1. Alternately, as seen in FIG. 4, the unit 18 may comprise multiple light sources 8, as indicated by letters A, B, and C, each of which is in individual holders 7 and has a separate lens 6, but where the three holders 7 are connected and part of a single unit. The walls of the holders 7 separate the light sources 8 and ensure the light from each travels only through its own lens, although the holders 7, lights 8, and lenses 6 form a single unit 18. As seen in FIG. 5, these walls may produce dark areas 22 between the respective beams of light produced by each light source 8. Each of the light sources 8 may be located at a different location within their respective holders 7, such as in FIG. 5, wherein light sources A and C are closer to their respective lenses 6 than light source B. The distance from light source B to its lens 6 may produce a narrow beam of light 20, whereas the shorter distance from light sources A and C to their lenses 6 may produce wider pools of light 21. Another optional configuration is seen in FIG. 6, which incorporates four light sources 8 with a single lens 6.

Figure 9:
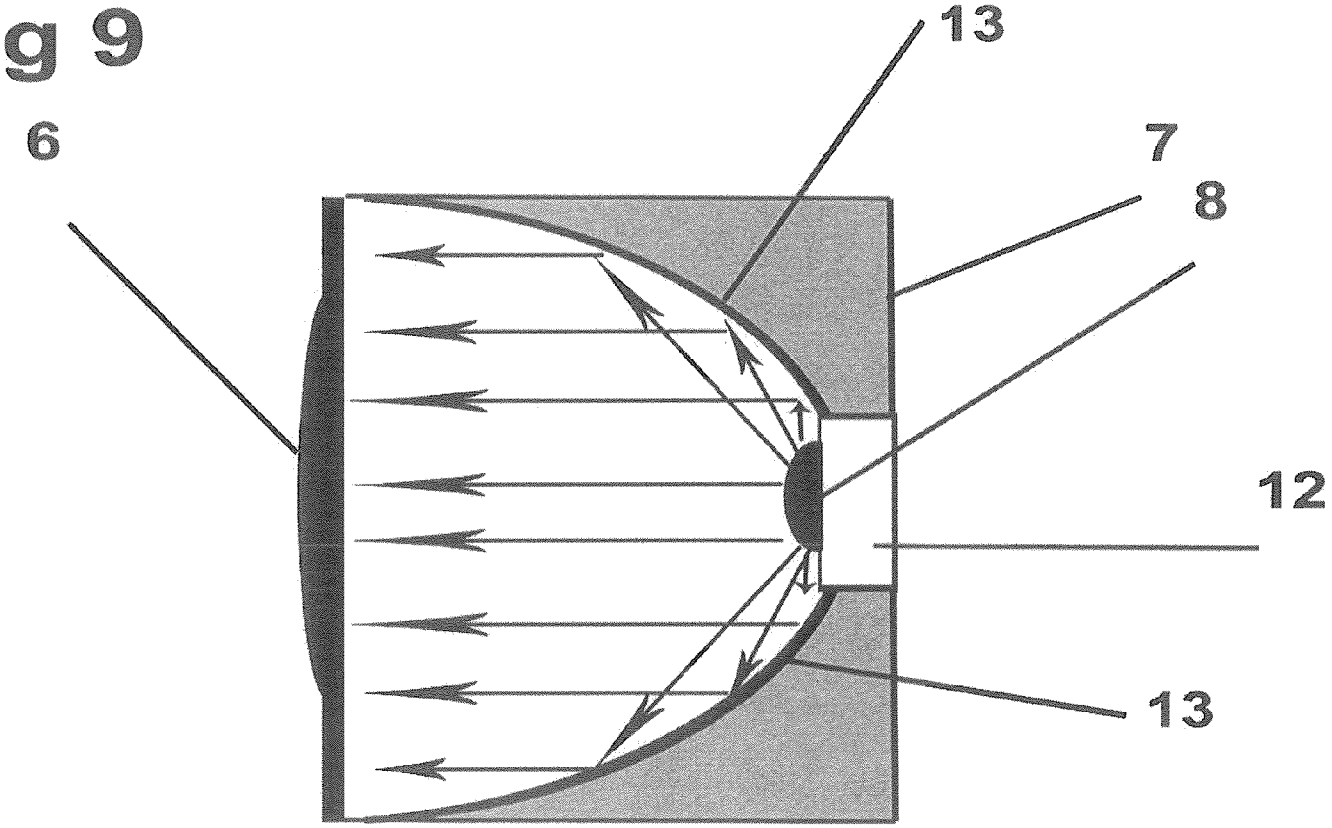
FIG. 9 is a side cross section view of a light source/lens holder with a conical reflective interior.

FIG. 9 shows a holder 7 that is in the shape of a cone. A surface mount light source 8 may be positioned to the rear of the holder 7. The light source 8 may be a wide angle beam LED, such as a 120 degree angle beam LED. This particular type of LED may have a much brighter illumination capability than a 3 mm or 5 mm LED. This type of LED may become hot and thus may require a heat sink 12 to disburse the heat evenly and enable it to run cool and not heat up. A chrome or mirror material 13 may cover the inside of the holder 7 to reflect the wide angle beam from the light source 8 and focus the light to the front of the holder 7 through the lens 6 to form a desired light effect.

Figure 10:
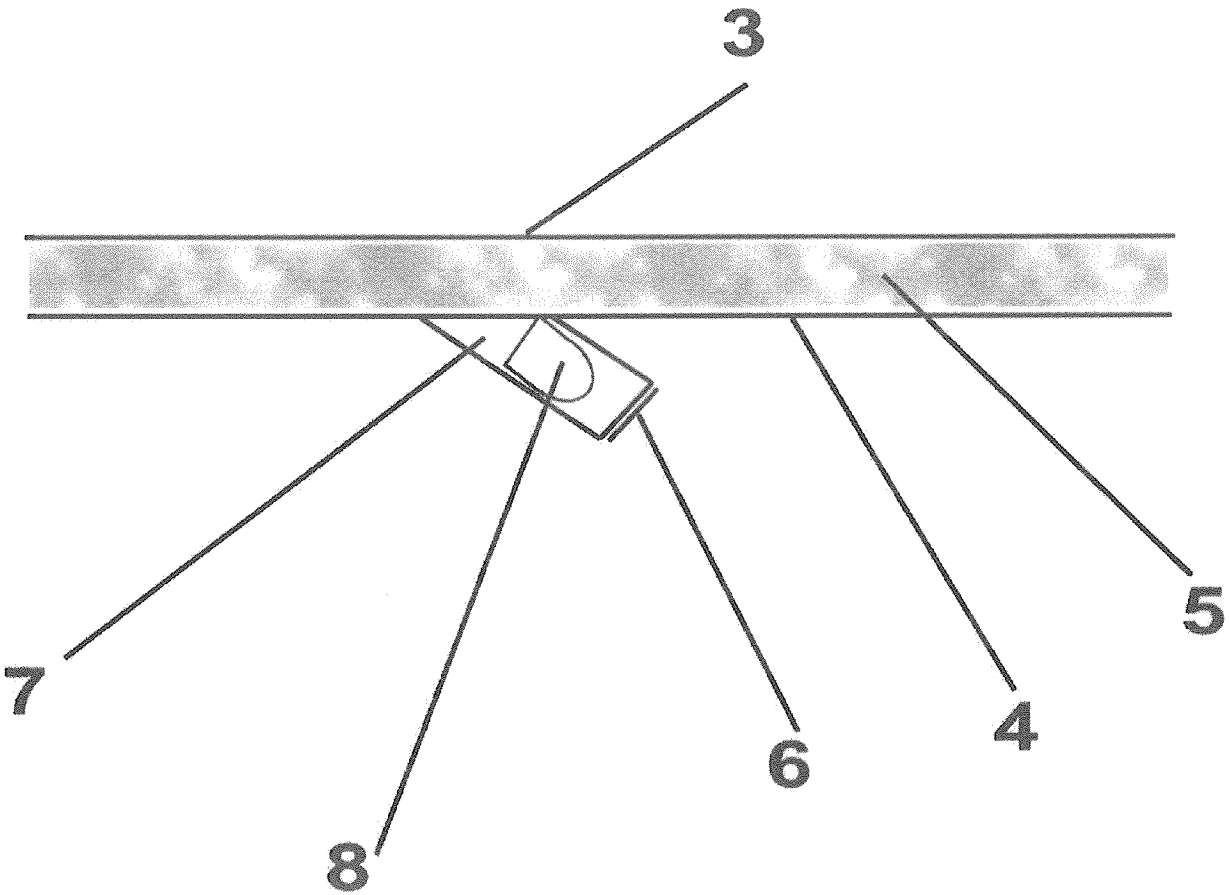
FIG. 10 is a side view of a light source and lens in a holder mounted to the underside of a hat brim.

As seen in FIG. 10, the light unit 18 may be located below the brim 14 rather than within the brim 14, directing light in a downward direction. The holder 7 may extend from the bottom of the brim 14 at a distance from the edge of the brim 14, rather than proximate the edge as described above.

Figure 11:
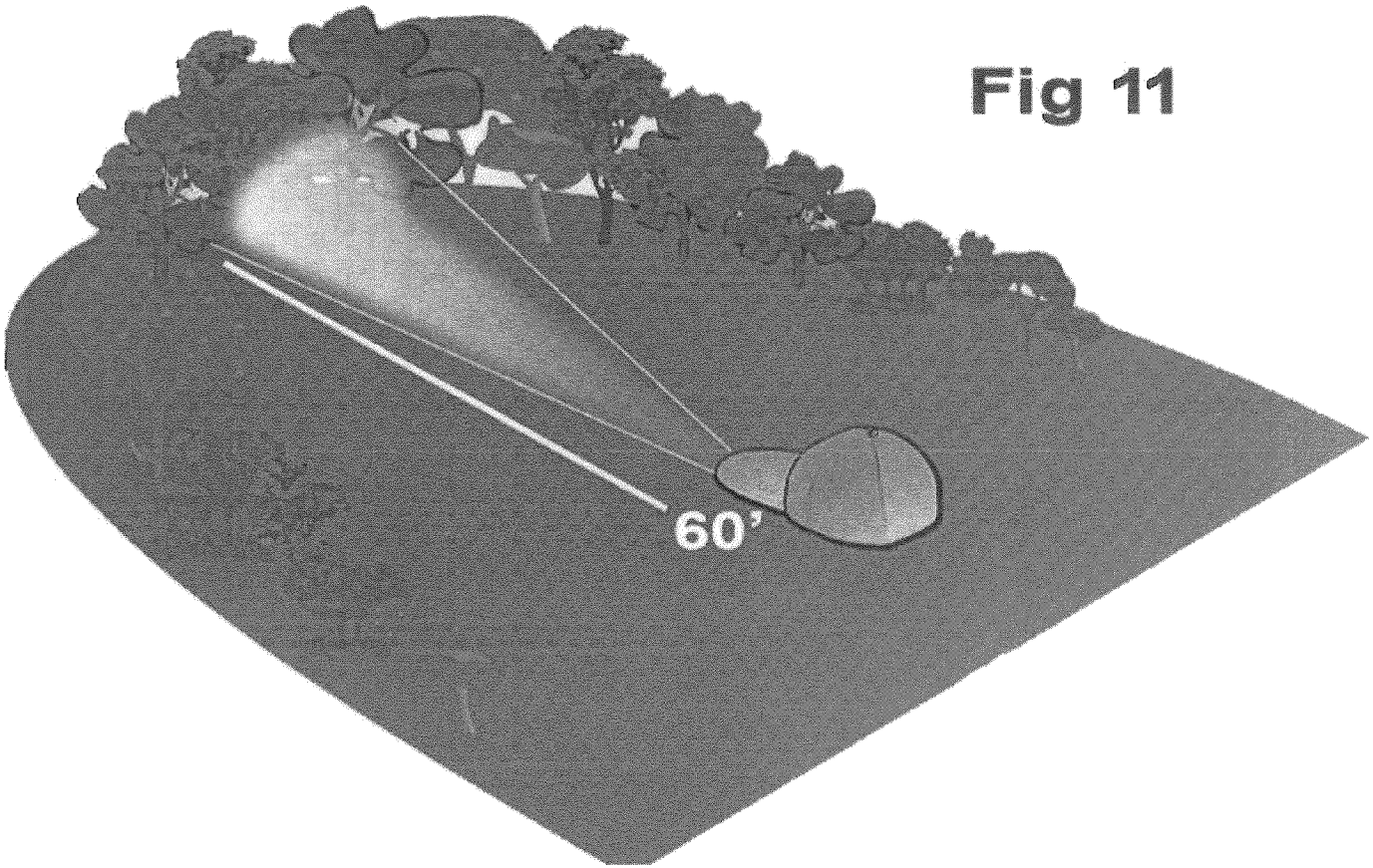
FIG. 11 is a perspective view of the range of illumination of the lighted headwear with a single light source.
Figure 12:
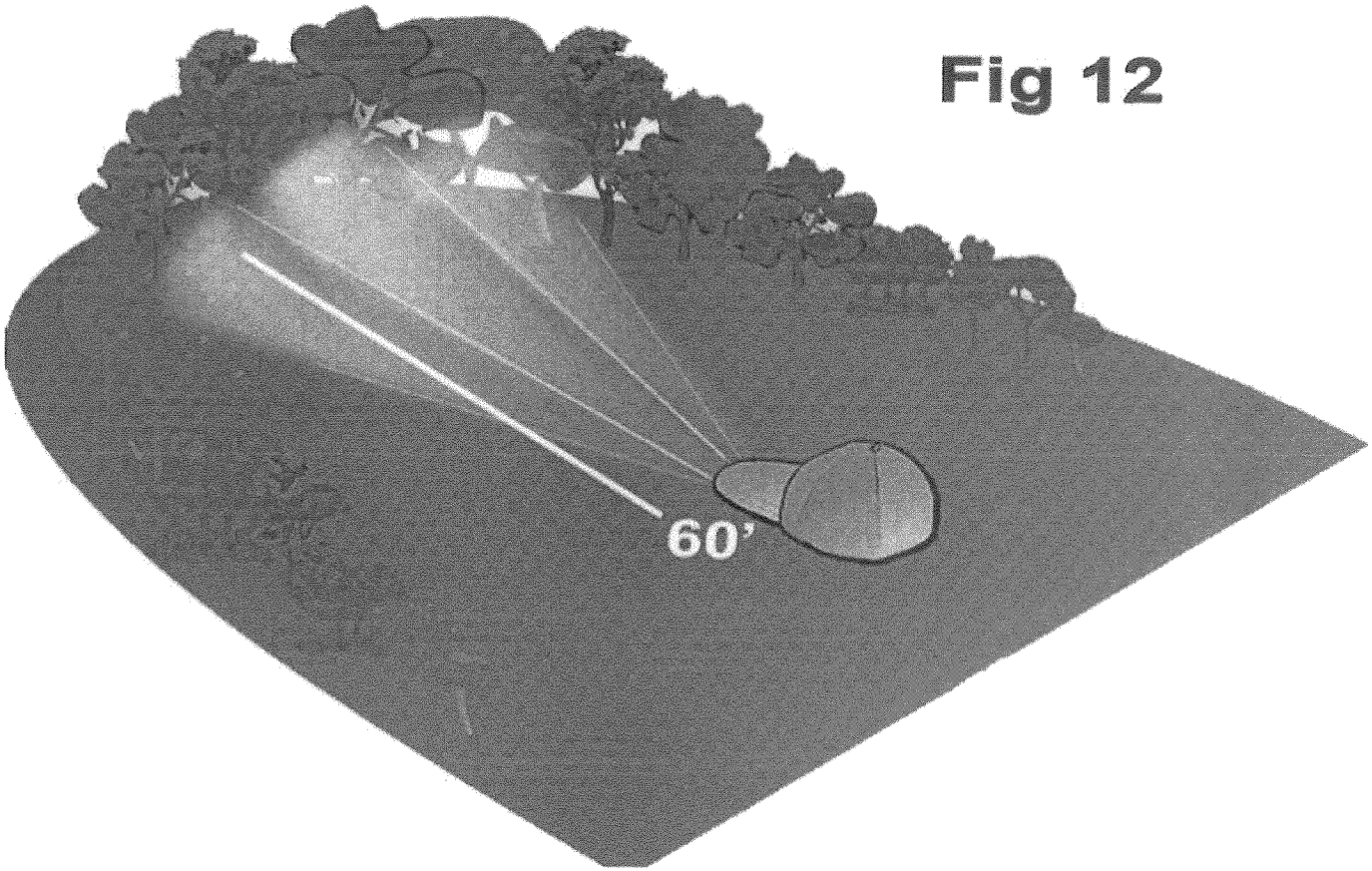
FIG. 12 is a perspective view of the range of illumination of the lighted headwear with three light sources.
Figure 13:
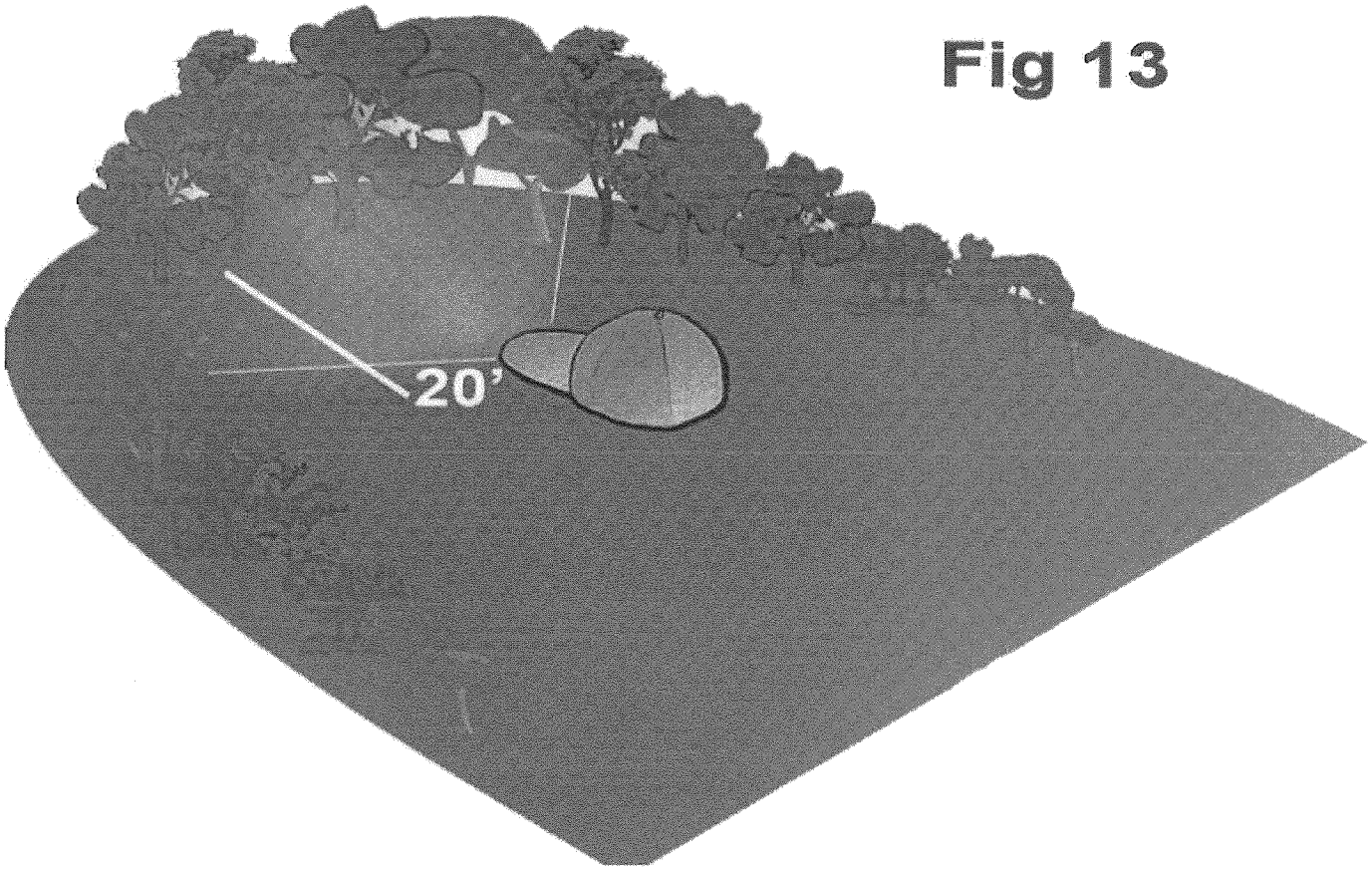
FIG. 13 is a perspective view of the range of illumination of current lighted headwear.

The lighted headwear may illuminate an area at night like a true torch flashlight. The lights 8 may be placed in a variety of configurations to produce different lighting effects, such as a narrow cylindrical beam of light just like that of a flashlight/torch or a rectangular beam of light. As seen in FIG. 11, a single light configuration may produce a narrow flashlight/torch beam of light that does not spray any light from side to side or above and below. It may be a single beam of light that can project effectively up to 60 feet. FIG. 12 shows a three light configuration, which likewise can project light up to 60 feet but produces a wider range due to its three beams of light. This is an improvement on present lighted hat technology, which never produces a focused beam and always has a spray of light to both sides and a spray of light projected above and below with a limited range, as shown in FIG. 13. This old technology is limited to providing only pools of light or, at best, a very wide cone shape of light that has no definitive beam in a narrow line of sight.

Figure 8:
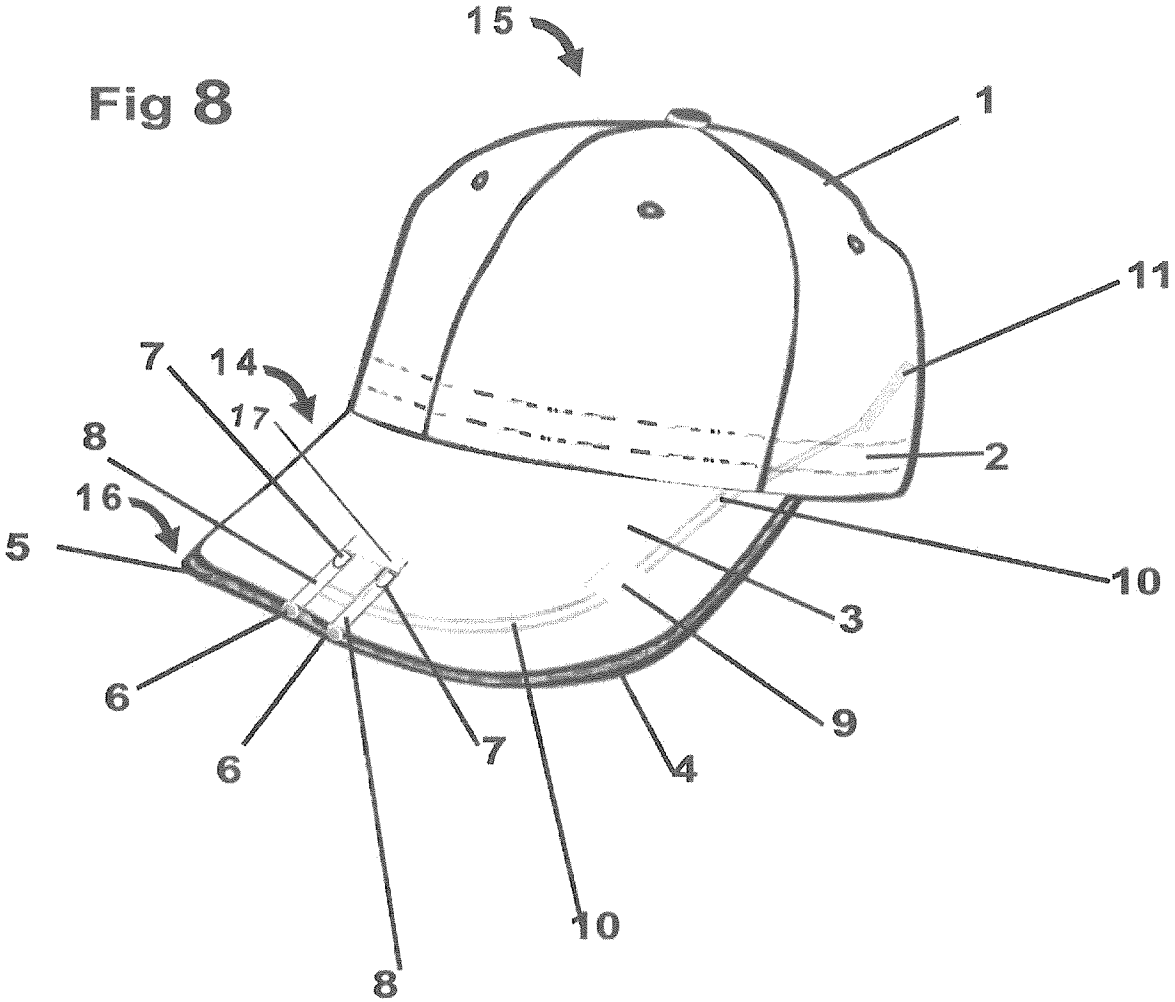
FIG. 8 is a perspective view of lighted headwear with two recessed light sources and two lenses spaced laterally from each other.

A single lens, holder, and LED unit 18 may be used with the present invention, or multiple units 18 may be utilized in a single hat to deliver multiple lens effects. For example, two separate units 18 may be placed at separate locations within the brim, providing two separate beams of light, as shown in FIG. 8. As noted above, each lens unit 18 may have one or multiple light sources 8 and each may have one or multiple lenses 6. There are numerous combinations and effects that can be created with multiple lens designs and multiple LEDs.

Because the light is being controlled by a lens 6 and is not reliant solely on the current LED/miniature light technology in the market, the present invention may be used to enhance and maximize not only presently available miniature lights, but any miniature light source that may be developed in the future. The present invention allows for countless lens designs that can be directed to many different markets and types of headwear. The present invention offers greater brightness than ever before and can be built into other headgear such as bicycle helmets and safety helmets where the brighter torch/flashlight beam is required.

Whereas, the devices and methods have been described in relation to the drawings and claims, it should be understood that other and further modifications, apart from those shown or suggested herein, may be made within the spirit and scope of this invention.

What is claimed is:

1. Lighted headwear comprising:

a brim; and a light unit located within the brim, the light unit comprising;

a holder having at least one chamber and an axis therethrough;

at least one lens located within the chamber and secured to the holder; and at least one light source located within the holder and separate and axially spaced from the at least one lens such that light produced by the light source projects through the chamber and out of the lens;

such that the at least one lens and the at least one chamber together converge light from the at least one light source to produce a beam of light narrower and further in distance than a beam of light produced by the at least one light source without the lens and chamber.

2. Lighted headwear comprising:

a brim; and a light unit located within the brim, the light unit comprising;

a holder with a chamber having a front end, a back end and an axis therebetween;

at least one lens located within the holder at the front end of the holder; and at least one light source located within the holder and axially spaced from the at least one lens such that light produced by the light source projects through the chamber along the holder, through the lens, and out the front end of the holder;

such that the at least one lens and the holder together converges light from the at least one light source to produce a beam of light narrower and further in distance than a beam of light produced by the at least one light source without the lens and chamber.

3. The lighted headwear of claim 2 further comprising a crown to which the brim is attached, where the brim has an edge proximate to the crown and an edge distal from the crown and where the light unit is located within the brim such that the lens is proximate the edge distal from the crown and the light produced by the light source projects away from the crown.

4. The lighted headwear of claim 1 where at least one of the at least one lens is a Fresnel lens.

5. The lighted headwear of claim 1 where at least one of the at least one lens is a rectangular lens.

6. The lighted headwear of claim 2 where the brim comprises a middle layer, a top layer atop the middle layer, and a bottom layer below the middle layer, and where the light unit is located between the top layer and the bottom layer.

7. The lighted headwear of claim 2 where the light unit extends downward from the brim at an oblique angle such that light produced by the light source is directed through the lens and downward from the brim at the oblique angle.

8. The lighted headwear of claim 2 where the holder is cylindrical.

9. The lighted headwear of claim 2 where the holder is shaped like a rectangular parallelepiped.

10. The lighted headwear of claim 2 where the holder has an interior surface and an exterior surface, where the interior surface is cylindrical, and where the exterior surface is shaped like a rectangular parallelepiped.

11. The lighted headwear of claim 2 where the holder and the lens are a single integral unit.

12. The lighted headwear of claim 2 where the holder comprises a plurality of chambers, where adjacent chambers are separated by walls and where each chamber houses one of the at least one light source.

13. The lighted headwear of claim 12 where the chambers are parallel to each other and the light sources direct light along parallel paths.

14. The lighted headwear of claim 12 where a first chamber housing a first light source is adjacent a second chamber housing a second light source and where the first light source is offset from the second light source such that no part of the first light source laterally overlaps any part of the second light source.

15. The lighted headwear of claim 12 where each chamber houses one of the at least one lens.

16. The lighted headwear of claim 2 where the holder is conical and has a reflective inner surface such that light from the light source reflects off the reflective inner surface and projects through the lens and out the front end of the holder.

17. The lighted headwear of claim 16 where the light source is a wide angle LED and where the light unit further comprises a heat sink.

18. The lighted headwear of claim 2 further comprising a second light unit located within the brim and spaced laterally from the light unit, the second light unit comprising:

a second holder with a front end and a back end;

at least one lens located within the second holder at the front end of the second holder; and at least one light source located within the second holder and axially spaced from the at least one lens such that light produced by the light source projects along the second holder, through the lens, and out the front end of the second holder.

* * * * *